US008848001B2

(12) United States Patent
Liu et al.

(10) Patent No.: US 8,848,001 B2
(45) Date of Patent: Sep. 30, 2014

(54) DRIVING METHOD OF BISTABLE DISPLAY DEVICE

(75) Inventors: Sheng-Chao Liu, Hsin-Chu (TW); Yao-Jen Hsieh, Hsin-Chu (TW); Ching-Huan Lin, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 685 days.

(21) Appl. No.: 13/070,597

(22) Filed: Mar. 24, 2011

(65) Prior Publication Data

US 2011/0279491 A1 Nov. 17, 2011

(30) Foreign Application Priority Data

May 14, 2010 (TW) ..... 99115564 A

(51) Int. Cl.
*G09G 5/10* (2006.01)
*G09G 3/34* (2006.01)

(52) U.S. Cl.
CPC ..... *G09G 3/344* (2013.01); *G09G 2310/061* (2013.01); *G09G 2320/0252* (2013.01); *G09G 2300/0842* (2013.01)
USPC ..... 345/690; 345/204; 345/208; 345/210; 345/76; 345/77; 345/107; 359/296

(58) Field of Classification Search
CPC ..... G09G 3/2022; G09G 3/2029; G09G 2320/0247; G09G 2320/0266; G09G 5/10
USPC ..... 345/204, 208–210, 690, 694, 76–77, 345/82–83, 89, 94–96, 691, 107, 296
See application file for complete search history.

(56) References Cited

U.S. PATENT DOCUMENTS

2006/0066598 A1* 3/2006 Floyd ..... 345/204
2008/0266225 A1* 10/2008 Kim ..... 345/88
2010/0295843 A1* 11/2010 Liu et al. ..... 345/214

* cited by examiner

*Primary Examiner* — Lun Yi Lao
*Assistant Examiner* — Shaheda Abdin
(74) *Attorney, Agent, or Firm* — WPAT, PC; Justin King

(57) ABSTRACT

An exemplary driving method is adapted for a bistable display device including a pixel array. The pixel array includes a plurality of first pixels and a plurality of second pixels arranged in a predetermined manner. The driving method includes the following steps of: during a first time period, providing the first pixels with a first pixel voltage for black insertion and providing the second pixels with a second pixel voltage different from the first pixel voltage; during a second time period following the first time period, providing the first pixels with the second pixel voltage for white insertion and maintaining the second pixels provided with the second pixel voltage for white insertion; and during a third time period following the second time period, initiating the first pixels to display a gray scale image and providing the second pixels with the first pixel voltage for black insertion.

14 Claims, 6 Drawing Sheets

DRIVING METHOD OF BISTABLE DISPLAY DEVICE

BACKGROUND

1. Technical Field

The present invention generally relates to fields of bistable display technologies and, particularly to a driving method adapted to a bistable display device.

2. Description of the Related Art

Bistable display devices, such as electrophoretic display devices (EPDs) are expected to be widely used as the next generation display technology because of their advantages of high contrast ratio, environmental protection, low power consumption, and slim.

A traditional bistable display device generally includes a thin film transistor (TFT) array backplane, a transparent front panel laminate (FPL), and a display layer such as an electrophoretic display layer. The TFT array backplane has a plurality of pixel electrodes formed thereon to define a plurality of pixels, the transparent FPL has a common electrode formed thereon. The electrophoretic display layer is sandwiched between the TFT array backplane and the transparent FPL and includes a plurality of electrophoretic cells (such as microcapsule structures, or micro-cup structures, etc.). Each of the electrophoretic cells includes an electrophoretic fluid and charged particles dispersed in the electrophoretic fluid. Herein, a single pixel generally includes one or more electrophoretic cells and driven to display a gray scale image by using a voltage difference between the pixel electrode and the common electrode to move the charged particles of the electrophoretic cell(s).

However, the traditional electrophoretic display device may encounter the issue of light aging in some degree. In detail, when the charged particles of the electrophoretic display layer are exposed to light, some characteristics of the charged particles would be changed, so that the response speed of the electrophoretic display layer becomes slower and causing the appearance of color block in the electrophoretic display device, resulting in the degradation of display quality consequently.

SUMMARY

Accordingly, the present invention is directed to a driving method of a bistable display device, in order to overcome the drawbacks of the bistable display device associated with the prior art.

Specifically, a driving method in accordance with an embodiment of the present invention adapted to a bistable display device including a pixel array. The pixel array includes a plurality of first pixels and a plurality of second pixels arranged in a predetermined manner. The driving method includes the following steps of: providing the first pixels with a first pixel voltage and providing the second pixels with a second pixel voltage during a first time period, wherein the first pixel voltage is different from the second pixel voltage; providing the first pixels with the second pixel voltage and maintaining the second pixels provided with the second pixel voltage during a second time period following the first time period; initiating the first pixels to display a gray scale image and providing the second pixels with the first pixel voltage during a third time period following the second time period; and providing the first pixels and the second pixels with a common voltage, the common voltage being alternately switched between the first pixel voltage and the second pixel voltage along with the switching of the first through third time periods and being substantially equal to the second pixel voltage during the first time period.

In one embodiment of the present invention, the driving method further includes the step of: providing the first pixels with the first pixel voltage and initiating the second pixels to display a gray scale image during a fourth time period following the third time period.

In one embodiment of the present invention, the driving method further includes the following steps of: providing the first pixels with the second pixel voltage and providing the second pixels with the first pixel voltage during a fifth time period; maintaining the first pixels provided with the second pixel voltage and proving the second pixels with the second pixel voltage during a sixth time period following the fifth time period; and providing the first pixels with the first pixel voltage and initiating the second pixels to display a gray scale image during a seventh time period following the sixth time period. Moreover, the bistable display device includes a first operation cycle and a second operation cycle performed in a predetermined order, the first operation cycle includes the first time period, the second time period, the third time period and the fourth time period, the second operation cycle includes the fifth time period, the sixth time period and the seventh time period. In addition, the common voltage is alternately switched between the first pixel voltage and the second pixel voltage along with the switching of the fifth through seventh time periods and is substantially equal to the second pixel voltage during the fifth time period.

In one embodiment of the present invention, the driving method further includes the step of: initiating the first pixels to display a gray scale image and providing the second pixels with the first pixel voltage during an eighth time period following the seventh time period, the eighth time period being comprised in the second operation cycle.

In one embodiment of the present invention, the driving method further includes the step of: arranging the first pixels and the second pixels of the pixel array in rows and columns, and moreover, the first pixels and the second pixels being alternately arranged in a row direction as well as in a column direction of the pixel array. The first pixels and the second pixels in a same column of the pixel array are electrically coupled to a same data line, or different data lines to receive first pixel voltage and second pixel voltage instead.

A driving method in accordance with another embodiment of the present invention is adapted to a bistable display device including a pixel array. The bistable display device includes a first operation cycle and a second operation cycle performed in a predetermined order. The driving method includes the following steps of: (1) in the first operation cycle, providing a first pixel voltage to a plurality of pixels of the pixel array during a first time period before writing a gray scale image; and providing a second pixel voltage to the pixels of the pixel array during a second time period following the first time period and before writing the gray scale image; (2) in the second operation cycle, providing the second pixel voltage to the pixels of the pixel array during a third time period before writing another gray scale image; and providing the first pixel voltage to the pixels of the pixel array during a fourth time period following the third time period and before writing the another gray scale image; and (3) providing a common voltage to the pixels of the pixel array in each of the first operation cycle and the second operation cycle and thereby forming a voltage difference cooperative with a corresponding one of the first pixel voltage and the second pixel voltage provided to the pixels of the pixel array during each of the first through fourth time periods. Moreover, the common voltage preferably changes along with the switching of the first through fourth time periods, and a value of the common voltage is selected from the group consisting of a value of the first pixel voltage and a value of the second pixel voltage.

A driving method in accordance with still another embodiment of the present invention is adapted to a bistable display device including a pixel array. The pixel array includes a plurality of first pixels and a plurality of second pixels arranged in a predetermined manner. The driving method includes the following steps of: driving each of the first pixels to display a first extreme optical state and maintaining a displayed optical state of each of the second pixels during a first time period; driving each of the first pixels to display a second extreme optical state and driving the second pixels to display the second extreme optical state during a second time period following the first time period; and driving each of the first pixels to display a first target optical state for displaying an image and driving each of the second pixels to display the first extreme optical state during a third time period following the second time period. Herein, a gray scale value of the first target optical state is between a gray scale value of the first extreme optical state and a gray scale value of the second extreme optical state.

In one embodiment of the present invention, the driving method can further include the following steps of: maintaining the first target optical state of each of the first pixels and driving each of the second pixels to display a second target optical state during a fourth time period following the third time period, a gray scale value of the second target optical state being between the gray scale value of the first extreme optical state and the gray scale value of the second extreme optical state.

In one embodiment, the driving method can further include the following steps of: maintaining the first target optical state of each of the first pixels and driving each of the second pixels to display the first extreme optical state during a fifth time period; driving each of the first pixels to display the second extreme optical state and driving each of the second pixels to display the second extreme optical state during a sixth time period following the fifth time period; and driving each of the first pixels to display the first extreme optical state and driving each of the second pixels to display a third target optical state for displaying an image during a seventh time period following the sixth time period. Herein, a gray scale value of the third target optical state is between the gray scale value of the first extreme optical state and the gray scale value of the second extreme optical state. Moreover, the bistable display device can include a first operation cycle and a second operation cycle performed in a predetermined order, the first operation cycle includes the first time period, the second time period, the third time period and the fourth time period, while the second operation cycle includes the fifth time period, the sixth time period and the seventh time period.

In one embodiment, the driving method can further include the step of: driving each of the first pixels to display a fourth target optical state and maintaining the third target optical state of each of the second pixels during an eighth time period following the seventh time period, a gray scale value of the fourth target optical state being between the gray scale value of the first extreme optical state and the gray scale value of the second extreme optical state, and the eighth time period being comprised in the second operation cycle.

A driving method in accordance with even still another embodiment of the present invention is adapted to a bistable display device including a pixel array. The bistable display device includes a first operation cycle and a second operation cycle performed in a predetermined order. The pixel array includes a plurality of pixels. The driving method includes the following steps of: (1) in the first operation cycle, driving each of the pixels of the pixel array to display a first extreme optical state during a first time period before displaying a target optical state; and driving each of the pixels of the pixel array to display a second extreme optical state during a second time period following the first time period and before displaying the target optical state; and (2) in the second operation cycle, driving each of the pixels of the pixel array to display the second extreme optical state during a third time period before displaying another target optical state; and driving each of the pixels of the pixel array to display the first extreme optical state during a fourth time period following the third time period and before displaying the another target optical state.

In the various embodiments of the present invention, by performing particular driving operations to the pixels of the bistable display device, such as black insertion and white insertion operations, so that color blocks appeared in the bistable display device associated with the prior art resulting from light aging are evened/uniformized in space and/or time, uneven phenomenon of color blocks is overcome, and therefore the display quality of image is improved.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Accordingly, the descriptions will be regarded as illustrative in nature and not as restrictive.

Figure 1:
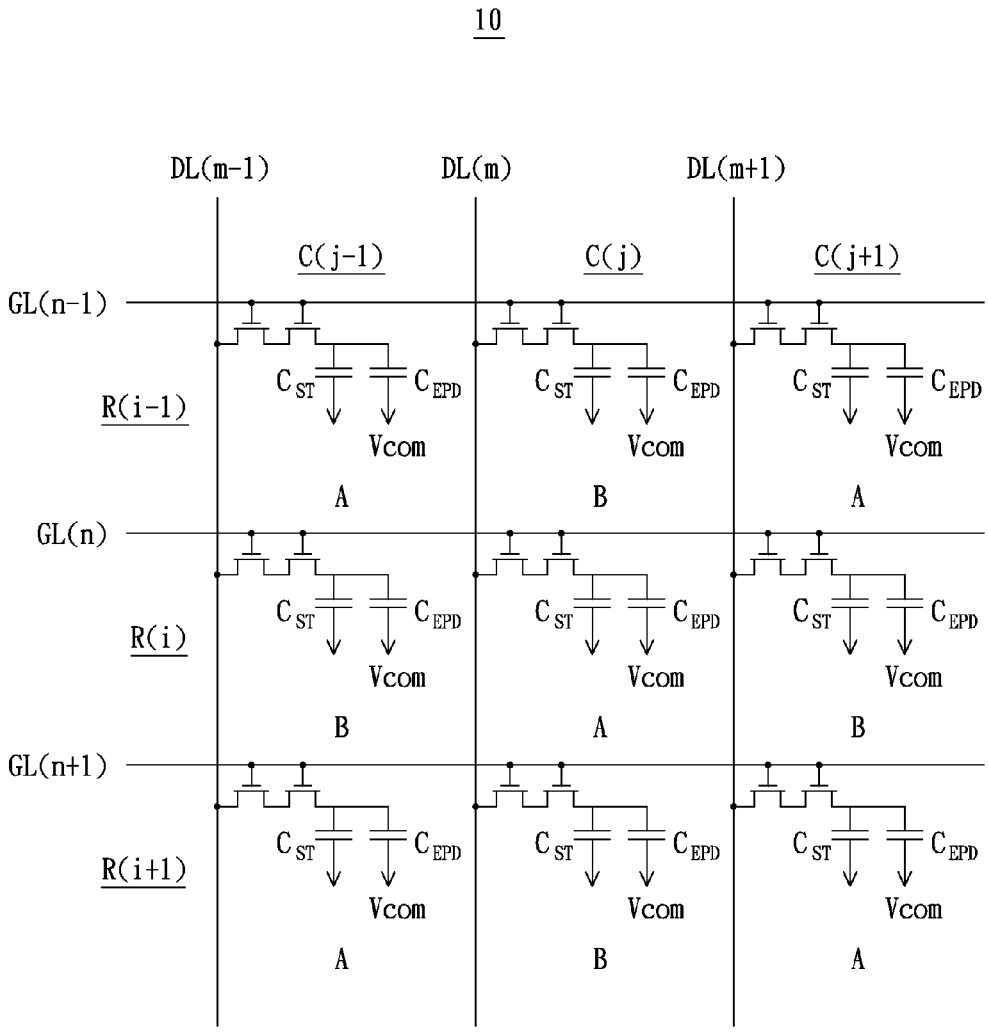
FIG. 1 shows a schematic partial circuit diagram of an exemplary embodiment of an electrophoretic display device.

Referring to FIG. 1, showing a schematic partial circuit diagram of an electrophoretic display device in accordance with an exemplary embodiment of the present invention. As illustrated in FIG. 1, the electrophoretic display device 10 includes gate lines GL(n−1)~GL(n+1), data lines DL(m−1)~DL(m+1), and a pixel array formed by pixels A and pixels B arranged in a predetermined manner. Each of the pixels A and pixels B generally includes a pixel electrode, a common electrode disposed opposite to the pixel electrode, and an electrophoretic display layer interposed between the pixel electrode and the common electrode. A voltage difference between the pixel electrode and the common electrode can drive charged particles in the electrophoretic display layer to move for displaying gray scale images. In this embodiment, the pixels A and pixels B are arranged in rows and columns. FIG. 1 shows three pixel columns C(j−1)~C(j+1) and three pixel rows R(i−1)~R(i+1) as an example for the purpose of illustration, but does not intend to limit the present invention. Herein, the pixels A and pixels B in each of the pixel columns C(j−1)~C(j+1) are alternately arranged in the column direction (that is, in an extension direction of the data lines DL(m−1)~DL(m+1)). The pixels A and pixels B in each of the pixel rows R(i−1)~R(i+1) are alternately arranged in the column direction (that is, in an extension direction of the gate lines GL(n−1)~GL(n+1)). Moreover, the pixels A and pixels B in a same pixel column are electrically coupled to the same data line. Where, n, m, i and j are all positive integers greater than zero.

Each of the pixels A and pixels B includes two cascaded transistors, a storage capacitor $C_{ST}$ and a pixel capacitor $C_{EPD}$. The gates of the two transistors are electrically coupled to one of the gate lines GL(n−1)~GL(n+1). One terminal of the storage capacitor $C_{ST}$ and one terminal of the pixel capacitor $C_{EPS}$ (corresponding to the pixel electrode) both are electrically coupled to one of the data lines DL(m−1)~DL(m+1) via the two transistors to receive a pixel voltage. The other terminal of the pixel capacitor $C_{EPS}$ serves as a common electrode to receive a common voltage Vcom. The other terminal of the storage capacitor $C_{ST}$ is electrically coupled to the common voltage Vcom or a grounding voltage.

Figure 2A:
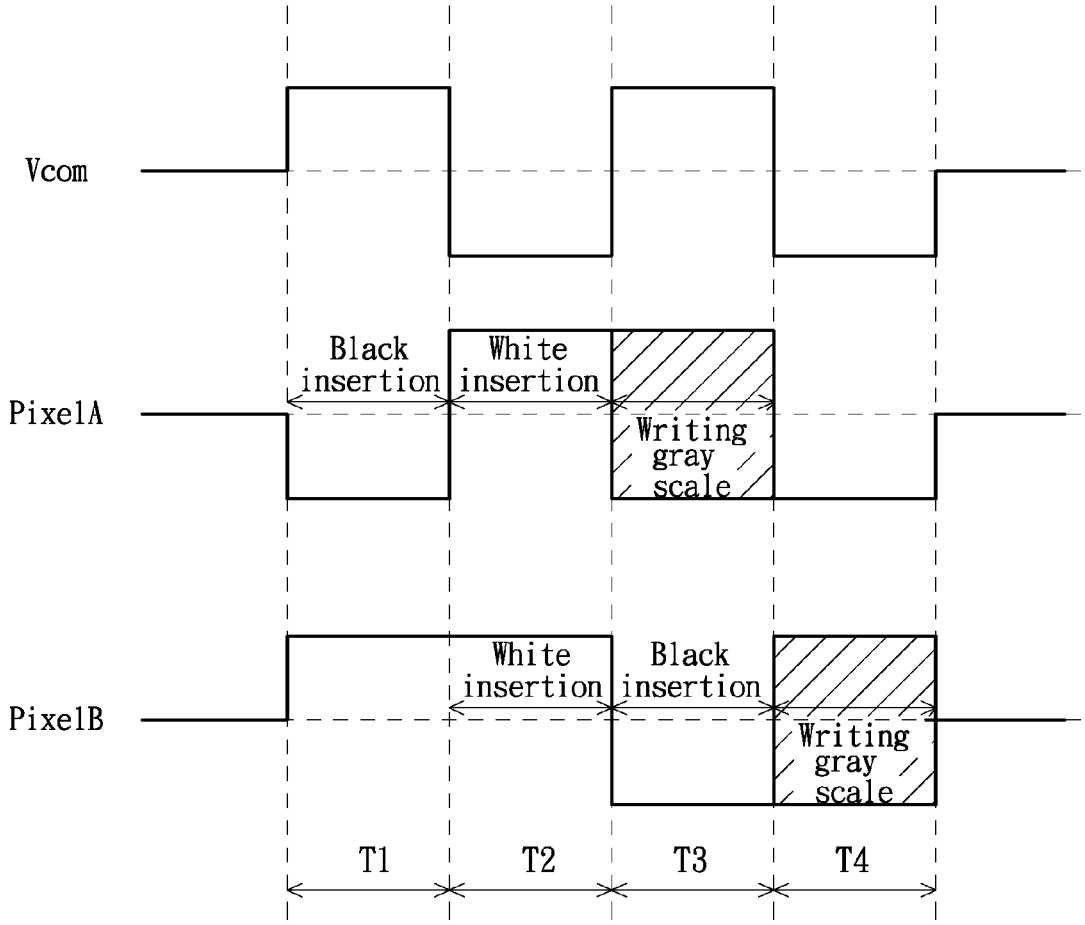
FIG. 2A shows timing diagrams of a plurality of voltages relevant to a driving method in accordance with an exemplary embodiment.

The following depicts a driving method adapted to the electrophoretic display device 10 in combination with FIG. 2A. FIG. 2A shows timing diagrams of the common voltage Vcom and pixel voltages provided to the pixels A and pixels B in an operation cycle of the electrophoretic display device 10. In the operation cycle, the gate lines GL(n−1)~GL(n+1) are sequentially enabled to allow the pixels A and pixels B to receive pixel voltages from the corresponding data lines DL(m−1)~DL(m+1). In the following, for the convenience of description, one pixel A and one pixel B are taken as an example for the purpose of illustration.

In detail, during a time period T1 of the operation cycle, the common voltage Vcom provided to the pixel A and pixel B is at a logic high level such as +15 V. The pixel voltage provided to the pixel A is at a logic low level such as −15V to perform a black insertion operation applied to the pixel A, so that the pixel A tends to display an extreme black optical state such as, a gray scale value is zero. The pixel voltage provided to the pixel B is at a logic high level such as +15 V, which is equal to the common voltage Vcom, so that the pixel B maintains its displayed optical state unchanged.

During a time period T2 of the operation cycle, the common voltage Vcom provided to the pixel A and pixel B changes to be at a logic low level such as −15 V. The pixel voltage provided to the pixel A changes to be at a logic high level such as +15V to perform a white insertion operation applied to the pixel A, so that the pixel A tends to display an extreme white optical state such as, a gray scale value is 255. The pixel voltage provided to the pixel B maintains at the logic high level but is different from the current common voltage Vcom, so that the pixel B performs a white insertion operation and therefore the pixel B tends to display an extreme white optical state.

During a time period T3 of the operation cycle, the common voltage Vcom provided to the pixel A and pixel B changes back to be at the logic high level. The pixel A is initiated to perform a gray scale writing operation and tends to display a target optical state for displaying a gray scale image. A gray scale value of the pixel A is between a gray scale value of the extreme black optical state and a gray scale value of the extreme white optical state, such as greater than or equal to the gray scale value 0 and less than or equal to the gray scale value 255. Furthermore, the pixel voltage provided to the pixel B changes to be at the logic low level such as −15V, which is different from the common voltage Vcom, so that the pixel B performs a black insertion operation and therefore tends to display an extreme black optical state.

During a time period T4 of the operation cycle, the common voltage Vcom provided to the pixel A and pixel B changes back to be at the logic low level. The pixel voltage provided to the pixel A is at the logic low level such as −15 V, which is equal to the common voltage Vcom, so that the pixel A maintains its displayed optical state unchanged. The pixel B is initiated to perform a gray scale writing operation and tends to display a target optical state for displaying a gray scale image. A gray scale value of the pixel B is between a gray scale value of the extreme black optical state and a gray scale value of the extreme white optical state, such as greater than or equal to the gray scale value 0 and less than or equal to the gray scale value 255.

Figure 2B:
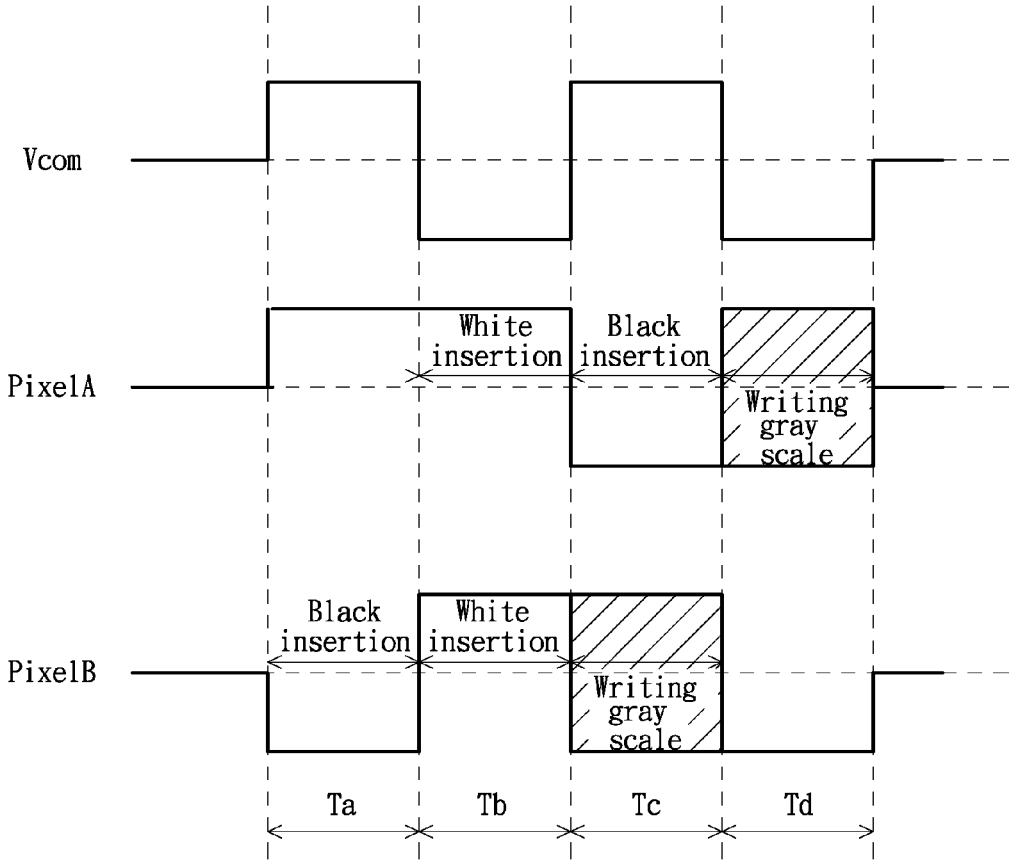
FIG. 2B shows timing diagrams of a plurality of voltages relevant to a driving method in accordance with another exemplary embodiment.

In the above-mentioned embodiment of the present invention, the driving manner of the pixel A is a sequence of black insertion, white insertion and writing gray scale, and the driving manner of the pixel B is another sequence of white insertion, black insertion and writing gray scale, but the present invention does not intend to be limited to the above-mentioned embodiment, other situation for example the illustration in FIG. 2B also can be adopted.

Referring to FIG. 2B, showing another exemplary timing diagrams of the common voltage Vcom and pixel voltages of the pixels A and pixels B in an operation cycle of the electrophoretic display device 10. In the operation cycle, the gate lines GL(n−1)~GL(n+1) are sequentially enabled to allow each of the pixels A and pixels B to receive pixel voltages from the corresponding data lines DL(m−1)~DL(m+1). In FIG. 2B, one pixel A and one pixel B are taken as an example, the driving manner of the pixel A is a sequence of white insertion, black insertion and writing gray scale, and the driving manner of the pixel B is another sequence of black insertion, white insertion and writing gray scale.

In detail, during a time period Ta of the operation cycle, the common voltage Vcom provided to the pixel A and pixel B is at a logic high level such as +15 V. The pixel voltage provided to the pixel A is at a logic high level such as +15V, which is equal to the common voltage Vcom, so that the pixel A maintains its displayed optical state unchanged. The pixel voltage provided to the pixel B is at a logic low level such as −15 V to perform a black insertion operation applied to the pixel B, and therefore the pixel B tends to display an extreme black optical state such as, a gray scale value is zero.

During a time period Tb of the operation cycle, the common voltage Vcom provided to the pixel A and pixel B changes to be at a logic low level such as −15 V. The pixel voltage provided to the pixel A maintains at the logic high level, which is different from the common voltage Vcom, so that the pixel A performs a white insertion operation and therefore the pixel A tends to display an extreme white optical state such as, a gray scale value is 255. The pixel voltage provided to the pixel B changes to be at a logic high level such as +15 V to perform a white insertion operation applied to the pixel B and therefore the pixel B tends to display an extreme white optical state.

During a time period Tc of the operation cycle, the common voltage Vcom provided to the pixel A and pixel B changes back to be at the logic high level. The pixel voltage provided to the pixel A changes to be at the logic low level such as −15V, which is different from the common voltage Vcom, so that the pixel A performs a black insertion operation and tends to display an extreme black optical state. Moreover, the pixel B performs a gray scale writing operation and tends to display a target optical state for gray scale image display. A gray scale value of the pixel B is between a gray scale value of the extreme black optical state and a gray scale value of the extreme white optical state, such as greater than or equal to the gray scale value 0 and less than or equal to the gray scale value 255.

During a time period Td of the operation cycle, the common voltage Vcom provided to the pixel A and pixel B changes back to be at the logic low level. The pixel A is initiated to perform a gray scale writing operation and tends to display a target optical state for gray scale image display. A gray scale value of the pixel A is between a gray scale value of the extreme black optical state and a gray scale value of the extreme white optical state, such as greater than or equal to the gray scale value 0 and less than or equal to the gray scale value 255. Moreover, the pixel voltage provided to the pixel B is at the logic low level such as −15V, which is equal to the common voltage Vcom, so that the pixel B maintains its displayed optical state unchanged.

In the above-mentioned embodiments of the present invention, by adopting the particular spatial arrangement design and different driving manners for the pixels A and pixels B, when the movement of charge particles of the electrophoretic display device 10 becomes slow resulting from light aging, the use of the driving manner of FIG. 2A facilitates to make the display state of the pixel A be a bit more white and the display state of the pixel B be a bit more black, the use of the driving manner of FIG. 2B facilitates to make the display state of the pixel A be a bit more black and the display state of the pixel B state be a bit more white. Therefore, the whole image would not appear clear/visible color blocks owning to the average of space, that is, uneven phenomenon of color blocks existing in the prior art is overcome.

Figure 2C:
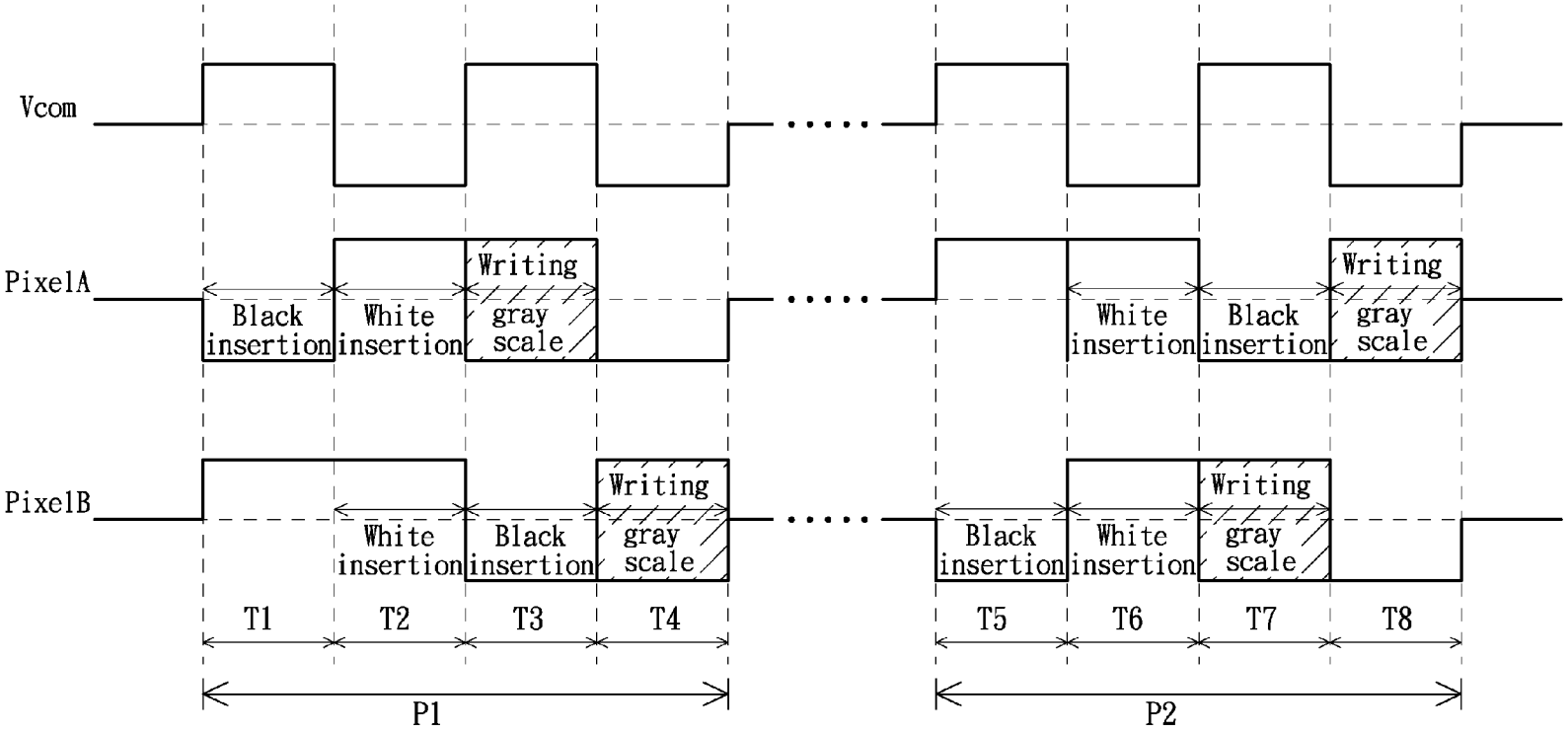
FIG. 2C shows timing diagrams of a plurality of voltages relevant to a driving method in accordance with still another exemplary embodiment.
Figure 2D:
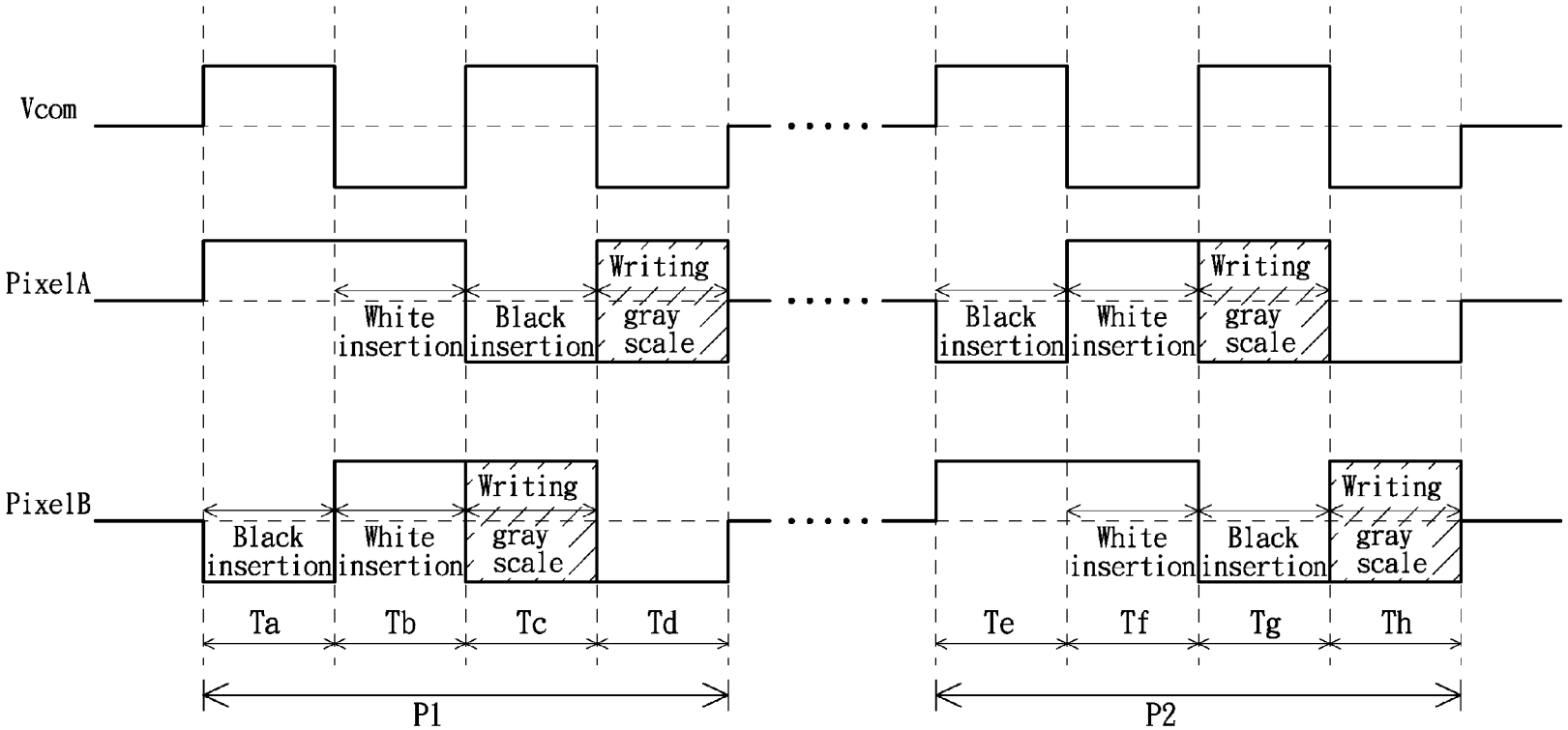
FIG. 2D shows timing diagrams of a plurality of voltages relevant to a driving method in accordance with even still another exemplary embodiment.

Of course, besides the use of the above-mentioned average of space, an average of time can be further used to reach the purpose of uniformizating the color blocks. For example, as shown in FIG. 2C, in a former operation cycle P1 of two adjacent operation cycles P1 and P2 of the electrophoretic display device 10, a driving manner for the pixel A is a sequence of black insertion during the time period T1, white insertion during the time period T2 and writing gray scale during the time period T3, and a driving manner for the pixel B is a sequence of white insertion during the time T2, black insertion during the time period T3 and writing gray scale during the time period T4 (similar to the driving manners for the respective pixel A and pixel B as shown in FIG. 2A). In a latter operation cycle P2 of the two adjacent operation cycles P1 and P2 of the electrophoretic display device 10, a driving manner for the pixel A is a sequence of white insertion during the time period T6, black insertion during the time period T7, and writing gray scale during the time period T8, and a driving manner for the pixel B is a sequence of black insertion during the time period T5, white insertion during the time period T6, and writing gray scale during the time period T7 (similar to the driving methods for the respective pixel A and pixel B as shown in FIG. 2B). In an alternative embodiment, as shown in FIG. 2D, in a former operation cycle P1 of two adjacent operation cycles P1 and P2 of the electrophoretic display device 10, a driving manner for the pixel A is sequence of white insertion during the time period Tb, black insertion during the time period Tc, and writing gray scale during the time period Td, and a driving manner for the pixel B is sequence of black insertion during the time period Ta, white insertion during the time period Tb, and writing gray scale during the time period Tc (similar to the driving methods for the respective pixel A and pixel B as shown in FIG. 2B). In a latter operation cycle P2 of the two adjacent operation cycles P1 and P2 of the electrophoretic display device 10, a driving manner for the pixel A is a sequence of black insertion during the time period Te, white insertion during the time period Tf, and writing gray scale during the time period Tg, and a driving manner for the pixel B is a sequence of white insertion during the time period Tf, black insertion during the time period Tg, and writing gray scale during the time period Th (similar to the driving methods for the respective pixel A and pixel B as shown in FIG. 2A).

In addition, only the average of time also can reach the purpose of uniformizating the color blocks besides the average of space. In detail, in one operation cycle of two adjacent operation cycles of the electrophoretic display device 10, the pixel A and pixel B both use the driving manner with a sequence of black insertion, white insertion and writing gray scale, And in the other operation cycle of the two adjacent operation cycles, the pixel A and pixel B both use the driving manner with a sequence of white insertion, black insertion and writing gray scale.

Figure 3:
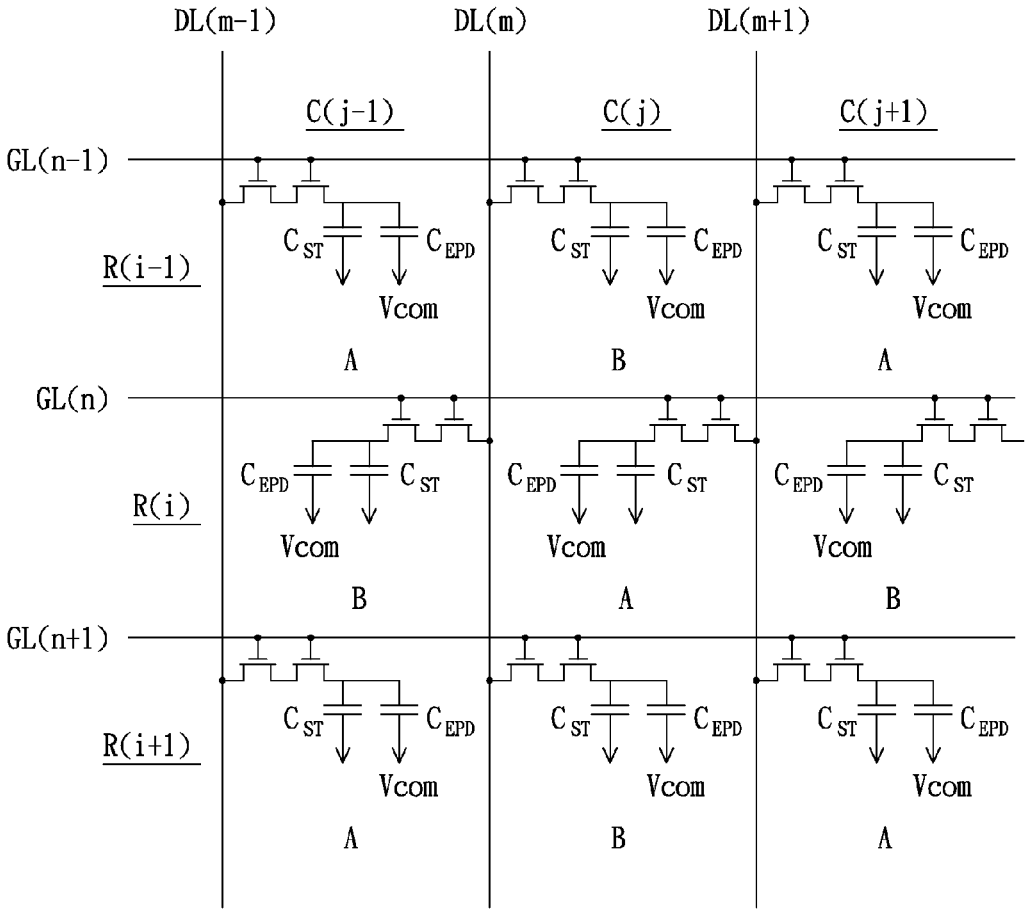
FIG. 3 shows a schematic partial circuit diagram of another exemplary embodiment of an electrophoretic display device.

In addition, it is noted that, in the above-mentioned embodiments of the present invention, the common voltage Vcom provided to the pixels A and pixels B changes along with the switching of the time periods of each the operation cycle, in order to provide a strong driving force to the charged particles of the electrophoretic display layer, but the invention does not intend to be limited to this, for example, the common voltage Vcom can also be set to a constant value. Furthermore, during the driving process of the pixels A and pixels B, as the pixels A and pixels B in the same column as shown in FIG. 1 are electrically coupled to a same data line, a pixel voltage of each the data line needs to be frequently switched in order to provide different pixel voltages to the pixels A and the pixels B, so that the power consumption is large. However, in order to reach the purpose of lower power consumption, the pixels A and pixels B can adopt the electrical connection manner as shown in FIG. 3, that is, the pixels A and pixels B in the same column are electrically coupled to different data lines to receive the pixel voltages.

In addition, the above-mentioned electrophoretic display device 10 can be a microcapsule electrophoretic display device or a micro-cup electrophoretic display device, but it does not intend to limit the present invention. Furthermore, the driving methods in accordance with the above-mentioned embodiments are not limited to be applied to the electrophoretic display device 10, and also can be applied to other types of bistable display devices.

In summary, in the various embodiments of the present invention, particular black insertion and white insertion operations are performed for all pixels of the bistable display device, the color blocks appeared in the bistable display device associated with the prior art resulting from light aging are evened/uniformized in space and/or time, so that uneven phenomenon of color blocks existing in the prior art is overcome, and therefore the display quality of image is improved.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving method adapted to a bistable display device comprising a pixel array, the pixel array comprising a plurality of first pixels and a plurality of second pixels arranged in a predetermined manner, the driving method comprising:

providing the first pixels with a first pixel voltage and providing the second pixels with a second pixel voltage during a first time period, wherein the first pixel voltage is different from the second pixel voltage;

providing the first pixels with the second pixel voltage and maintaining the second pixels provided with the second pixel voltage during a second time period following the first time period;

initiating the first pixels to display a gray scale image and providing the second pixels with the first pixel voltage during a third time period following the second time period; and providing the first pixels and the second pixels with a common voltage, wherein the common voltage is alternately switched between the first pixel voltage and the second pixel voltage along with the switching of the first through third time periods and is substantially equal to the second pixel voltage during the first time period.

2. The driving method as claimed in claim 1, further comprising:

providing the first pixels with the first pixel voltage and initiating the second pixels to display a gray scale image during a fourth time period following the third time period.

3. The driving method as claimed in claim 2, further comprising:

providing the first pixels with the second pixel voltage and providing the second pixels with the first pixel voltage during a fifth time period;

maintaining the first pixels provided with the second pixel voltage and proving the second pixels with the second pixel voltage during a sixth time period following the fifth time period; and providing the first pixels with the first pixel voltage and initiating the second pixels to display a gray scale image during a seventh time period following the sixth time period;

wherein the bistable display device comprises a first operation cycle and a second operation cycle performed in a predetermined order, the first operation cycle comprises the first time period, the second time period, the third time period and the fourth time period, the second operation cycle comprises the fifth time period, the sixth time period and the seventh time period; the common voltage is alternately switched between the first pixel voltage and the second pixel voltage along with the switching of the fifth through seventh time periods and is substantially equal to the second pixel voltage during the fifth time period.

4. The driving method as claimed in claim 3, further comprising:

initiating the first pixels to display a gray scale image and providing the second pixels with the first pixel voltage during an eighth time period following the seventh time period, wherein the eighth time period is comprised in the second operation cycle.

5. The driving method as claimed in claim 1, further comprising:

arranging the first pixels and the second pixels of the pixel array in rows and columns, the first pixels and the second pixels being alternately arranged in a row direction as well as a column direction of the pixel array.

6. The driving method as claimed in claim 5, further comprising:

electrically coupling the first pixels of any one column of the pixel array and the second pixels in the same column to a same data line.

7. The driving method as claimed in claim 5, further comprising:

electrically coupling the first pixels of any one column of the pixel array to a data line to receive the pixel voltages; and electrically coupling the second pixels in the same column to another data line to receive the pixel voltages.

8. A driving method adapted to a bistable display device comprising a pixel array, the pixel array comprising a plurality of first pixels and a plurality of second pixels arranged in a predetermined manner, the driving method comprising:

driving each of the first pixels to display a first extreme optical state and maintaining a displayed optical state of each of the second pixels during a first time period;

driving each of the first pixels to display a second extreme optical state and driving each of the second pixels to display the second extreme optical state during a second time period following the first time period; and driving each of the first pixels to display a first target optical state for image display and driving each of the second pixels to display the first extreme optical state during a third time period following the second time period, wherein a gray scale value of the first target optical state is between a gray scale value of the first extreme optical state and a gray scale value of the second extreme optical state.

9. The driving method as claimed in claim 8, further comprising:

maintaining the first target optical state of each of the first pixels and driving each of the second pixels to display a second target optical state during a fourth time period following the third time period, wherein a gray scale value of the second target optical state is between the gray scale value of the first extreme optical state and the gray scale value of the second extreme optical state.

10. The driving method as claimed in claim 9, further comprising:

maintaining the first target optical state of each of the first pixels and driving each of the second pixels to display the first extreme optical state during a fifth time period;

driving each of the first pixels to display the second extreme optical state and driving each of the second pixels to display the second extreme optical state during a sixth time period following the fifth time period; and driving each of the first pixels to display the first extreme optical state and driving each of the second pixels to display a third target optical state for image display during a seventh time period following the sixth time period, wherein a gray scale value of the third target optical state is between the gray scale value of the first extreme optical state and the gray scale value of the second extreme optical state;

wherein the bistable display device comprises a first operation cycle and a second operation cycle performed in a predetermined order, the first operation cycle comprises the first time period, the second time period, the third time period and the fourth time period, the second operation cycle comprises the fifth time period, the sixth time period and the seventh time period.

11. The driving method as claimed in claim 10, further comprising:

driving each of the first pixels to display a fourth target optical state and maintaining the third target optical state of each of the second pixels during an eighth time period following the seventh time period, wherein a gray scale value of the fourth target optical state is between the gray scale value of the first extreme optical state and the gray scale value of the second extreme optical state, and the eighth time period is comprised in the second operation cycle.

12. The driving method as claimed in claim 8, further comprising:

arranging the first pixels and the second pixels of the pixel array in rows and columns, the first pixels and the second pixels being alternately arranged in a row direction as well as in a column direction of the pixel array.

13. The driving method as claimed in claim 12, further comprising:

electrically coupling the first pixels of any one column of the pixel array and the second pixels in the same column to a same data line.

14. The driving method as claimed in claim 12, further comprising:

electrically coupling the first pixels of any one column of the pixel array are electrically coupled to a data line to receive the pixel voltages; and electrically coupling the second pixels in the same column to another data line to receive the pixel voltages.

* * * * *